US010099833B2

(12) United States Patent
Saulas et al.

(10) Patent No.: US 10,099,833 B2
(45) Date of Patent: Oct. 16, 2018

(54) PANEL INTERLOCKING DEVICE FOR A CARTON AND BLANK THEREFOR

(71) Applicant: Westrock Packaging Systems, LLC, Norcross, GA (US)

(72) Inventors: Alain Saulas, Chateauroux (FR); Tsugihiko Suzuki, Henriko, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 15/307,422

(22) PCT Filed: Apr. 29, 2015

(86) PCT No.: PCT/US2015/028136

§ 371 (c)(1),
(2) Date: Oct. 28, 2016

(87) PCT Pub. No.: WO2015/171376

PCT Pub. Date: Nov. 12, 2015

(65) Prior Publication Data

US 2017/0057717 A1 Mar. 2, 2017

Related U.S. Application Data

(60) Provisional application No. 61/988,446, filed on May 5, 2014.

(51) Int. Cl.
*B65D 71/12* (2006.01)
*B65D 5/02* (2006.01)
(Continued)

(52) U.S. Cl.
CPC ..... *B65D 71/12* (2013.01); *B65D 5/02* (2013.01); *B65D 5/42* (2013.01); *B65D 71/00* (2013.01);
(Continued)

(58) Field of Classification Search
CPC . B65D 71/12; B65D 5/42; B65D 5/02; B65D 2571/00228; B65D 2571/00716;
(Continued)

(56) References Cited

U.S. PATENT DOCUMENTS 3,380,645 A * 4/1968 Pierce, Jr. ..... B65D 5/02 229/195
4,600,140 A * 7/1986 Milliens ..... B65D 71/12 206/140
(Continued)

FOREIGN PATENT DOCUMENTS

| | | |
|---|---|---|
| EP | 1098822 | 5/2001 |
| FR | 2641523 | 7/1990 |
| FR | 2824537 | 10/2003 |

*Primary Examiner* — Christopher Demeree
(74) *Attorney, Agent, or Firm* — WestRock Intellectual Property Group

(57) ABSTRACT

A locking device for a carton includes a first part (F) defined in a first panel (12) and a second part (M) defined in a second panel (14). The first part includes a female tab (22) struck from the first panel and foldably coupled thereto. The second part includes a male tab (20) struck from the second panel and foldably coupled thereto. The male tab is hinged to the second panel by a first non-linear fold line (24) and is receivable in an aperture created by folding the female tab out of the plane of the first panel so as to secure the first and second panels together. The male tab includes at least one weakened line (28) for facilitating folding of the male tab about the first non-linear fold line (24). An edge (30) of the female tab braces against the male tab so as to maintain the male tab in a folded or locked configuration.

19 Claims, 9 Drawing Sheets

(51) Int. Cl.
*B65D 5/42* (2006.01)
*B65D 71/00* (2006.01)

(52) U.S. Cl.
CPC ..... *B65D 2571/00154* (2013.01); *B65D 2571/00228* (2013.01)

(58) Field of Classification Search
CPC .. B65D 2571/0016; B65D 2571/00172; B65D 71/14
USPC ..... 229/198.2, 103.2, 185, 148, 150, 154, 229/194, 195; 206/140, 427, 434, 429
See application file for complete search history.

(56) References Cited

U.S. PATENT DOCUMENTS

| | | | | |
|---|---|---|---|---|
| 4,723,699 | A * | 2/1988 | Brown | B65D 5/4279 206/140 |
| 4,773,540 | A | 9/1988 | Schuster | |
| 8,376,213 | B2 * | 2/2013 | Brand | B65D 71/16 206/140 |
| 9,174,784 | B2 * | 11/2015 | Bakx | B65D 71/14 |
| 2008/0257945 | A1 * | 10/2008 | Auclair | B65D 71/20 229/185 |

* cited by examiner 110
112
F
130
122
123
114
124a
126
124b
M
128
120
121

210
212
F
230
222
223
231
214
226
224a
224b
M
229
220
221

PANEL INTERLOCKING DEVICE FOR A CARTON AND BLANK THEREFOR

CROSS-REFERENCE TO RELATED APPLICATIONS

This application is a National Phase application of PCT Application PCT/US15/28136, filed Apr. 29, 2015, which claims the benefit of U.S. Provisional Patent Application No. 61/988,446, filed May 5, 2014, which is incorporated herein by reference in its entirety.

TECHNICAL FIELD

The present invention relates to panel interlocking device for a carton and to a blank for forming the same more specifically, but not exclusively, to a carton for packaging one or more articles, the carton having a pair of at least partially overlapping panels secured to one another by a complementary locking mechanism.

BACKGROUND

In the field of packaging it is often required to provide consumers with a package comprising multiple primary product containers. Such multi-packs are desirable for shipping and distribution and for display of promotional information. For cost and environmental considerations, such cartons or carriers need to be formed from as little material as possible and cause as little wastage in the materials from which they are formed as possible. Another consideration is the strength of the packaging and its suitability for holding and transporting large weights of articles.

In one aspect, the present invention seeks to provide an improvement in the field of packaging by providing a new locking structure which enables a pair of panels of a carton to be locked or secured together.

SUMMARY

According to a first aspect of the invention there is provided a locking device for a carton.

The locking device comprises:

a first part defined in a first panel; and a second part associated with a second panel, the first part comprising a female tab struck from the first panel and foldably coupled thereto, the female tab defining an aperture in the first panel when folded out of a plane of the first panel, the second part comprising a male tab foldably coupled to the second panel along a non-linear fold line, wherein the male tab is foldable about the non-linear fold line into a braced position in the aperture wherein the female tab leans against the male tab so as to maintain the male tab in the braced position whereby the first and second panels are secured together.

Optionally, the second part may further comprise at least one weakened line defined in the male tab for facilitating folding of the male tab about the non-linear fold line.

Optionally, the at least one weakened line may comprise one or more fold lines.

Optionally, the one or more fold lines may comprise one selected from the group consisting of a single cut, a single score, a single half cut, a line of perforations, a line of cuts, a line of short slits, a line of half cuts, a line of scores and any combination thereof.

Optionally, the one or more fold lines may comprise two or more parallel fold lines each being one selected from the group consisting of a single cut, a single score, a single half cut, a line of perforations, a line of cuts, a line of short slits, a line of half cuts, a line of scores and any combination thereof.

Optionally, the non-linear fold line may comprise a first linear fold line and a second linear fold line arranged to define an obtuse angle therebetween.

Optionally, the non-linear fold line may further comprise a cutline disposed between the first linear fold line and the second linear fold line.

Optionally, the non-linear fold line may comprise first and second curved fold lines arranged to define a continuous arc with a cutline disposed therebetween.

Optionally, the at least one weakened line may intersect with the non-linear fold line.

Optionally, the at least one weakened line may intersect with the cutline.

Optionally, the at least one weakened line may comprise two or more fold lines disposed in parallel relationship with each other.

Optionally, the female tab may comprise a free end which is disposed in abutment on the male tab when the male tab is in the braced position. The free end of the female tab may be shaped complementarily to the non-linear fold line to form a mandrel for folding the male tab into a non-planar structure.

Optionally, the free end of the female tab may be non-linear in shape.

Optionally, the free end of the female tab may be concaved.

Optionally, the free end of the female tab may be convex.

Optionally, the male tab may be struck from the second panel.

Optionally, the male tab may extend from a free edge of the second panel.

According to a second aspect of the invention there is provided a blank for forming a carton.

The blank comprises:

a first panel including a first part of a locking device; and a second panel including a second part of a locking device, wherein the first part comprises a female tab struck from the first panel and foldably coupled thereto, the female tab defining an aperture when folded out of a plane of the first panel, wherein the second part comprises a male tab foldably coupled to the second panel by a non-linear fold line, and wherein the male tab is foldable about the non-linear fold line into a braced position in the aperture wherein the female tab leans against the male tab so as to maintain the male tabs in the braced position whereby the first and second panels are secured together.

Optionally, the second part may further comprise at least one weakened line defined in the male tab for facilitating folding of the male tab about the non-linear fold line.

Optionally, the at least one weakened line may comprise one or more fold lines.

Within the scope of this application, it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS

Detailed descriptions of specific embodiments of the locking device, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the locking device, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

In the embodiments detailed herein, the terms "carton" and "carrier" refer, for the non-limiting purpose of illustrating the various features of the invention, to a container for engaging, carrying, and/or dispensing articles, such as cans and bottles. However, it is contemplated that the teachings of the invention can be applied to various containers, which may or may not be tapered and/or cylindrical. Other exemplary articles include bottles (for example metallic, glass or plastics bottles), cans (for example aluminium cans), tins, pouches, packets and the like.

Figure 1:
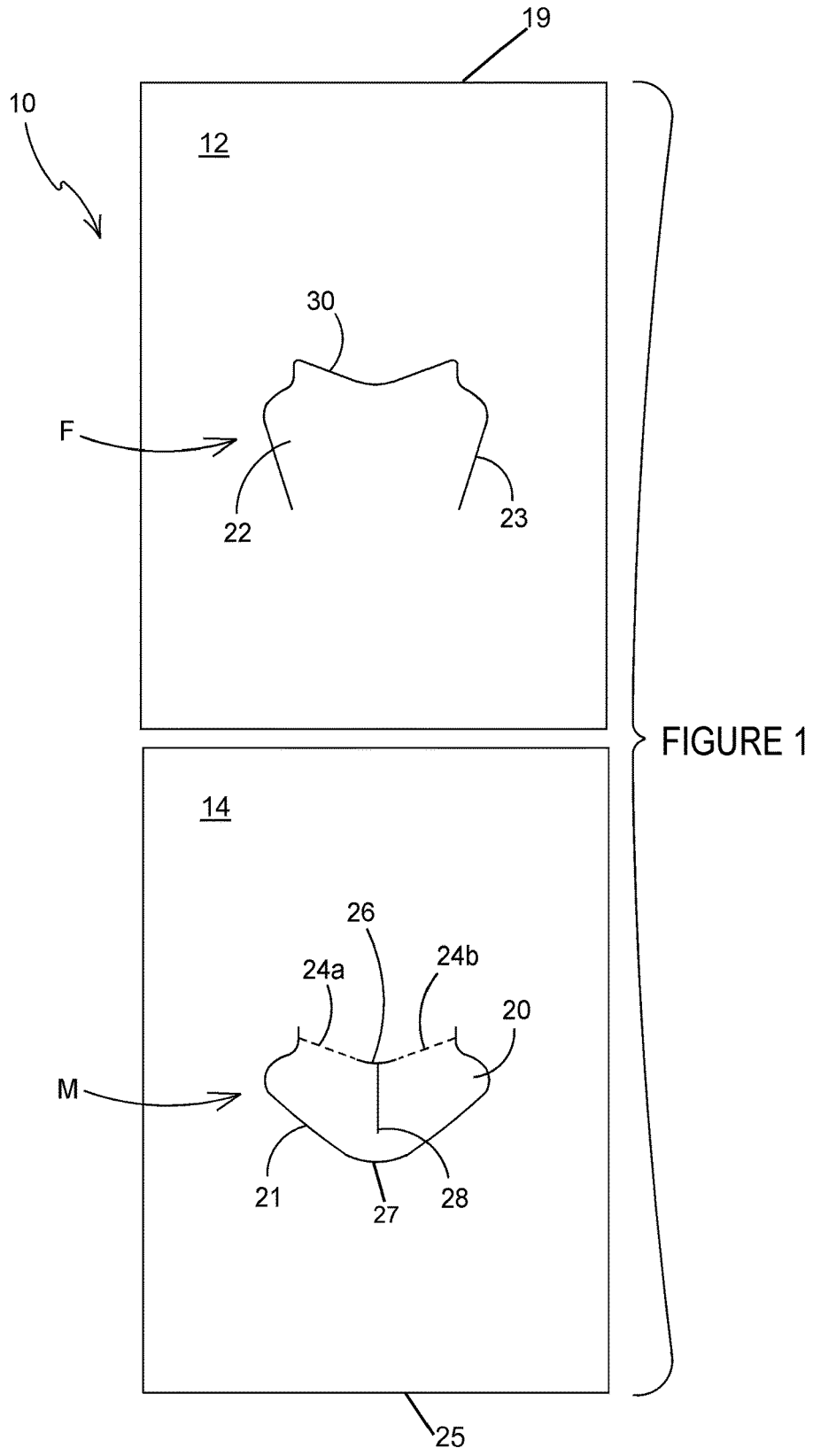
FIG. 1 is a plan view of blank having a complementary locking mechanism according to an embodiment of the invention.

Referring to FIG. 1, there is shown a blank 10. The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, for example, to provide a carton having a complementary locking mechanism described in more detail below.

Referring to FIG. 1, the blank 10 comprises a first panel 12 and a second panel 14. In the embodiment illustrated in FIG. 1 the first panel 12 and the second panel 14 are shown as separate panels. In alternative embodiments, the first panel 12 and the second panel 14 may form part of the same blank and may be hingedly connected to one another by one or more additional panels.

In some embodiments the first panel and the second panel may form a composite panel of a carton. The carton comprises a plurality of panels forming a tubular structure having a plurality of walls including a top wall, a bottom wall and opposed side walls. The composite panel formed by the first panel and the second panel may form one of the plurality of walls of the tubular structure. Optionally, each end of the tubular structure may be at least partially closed by one or more end closure panels.

Figure 2:
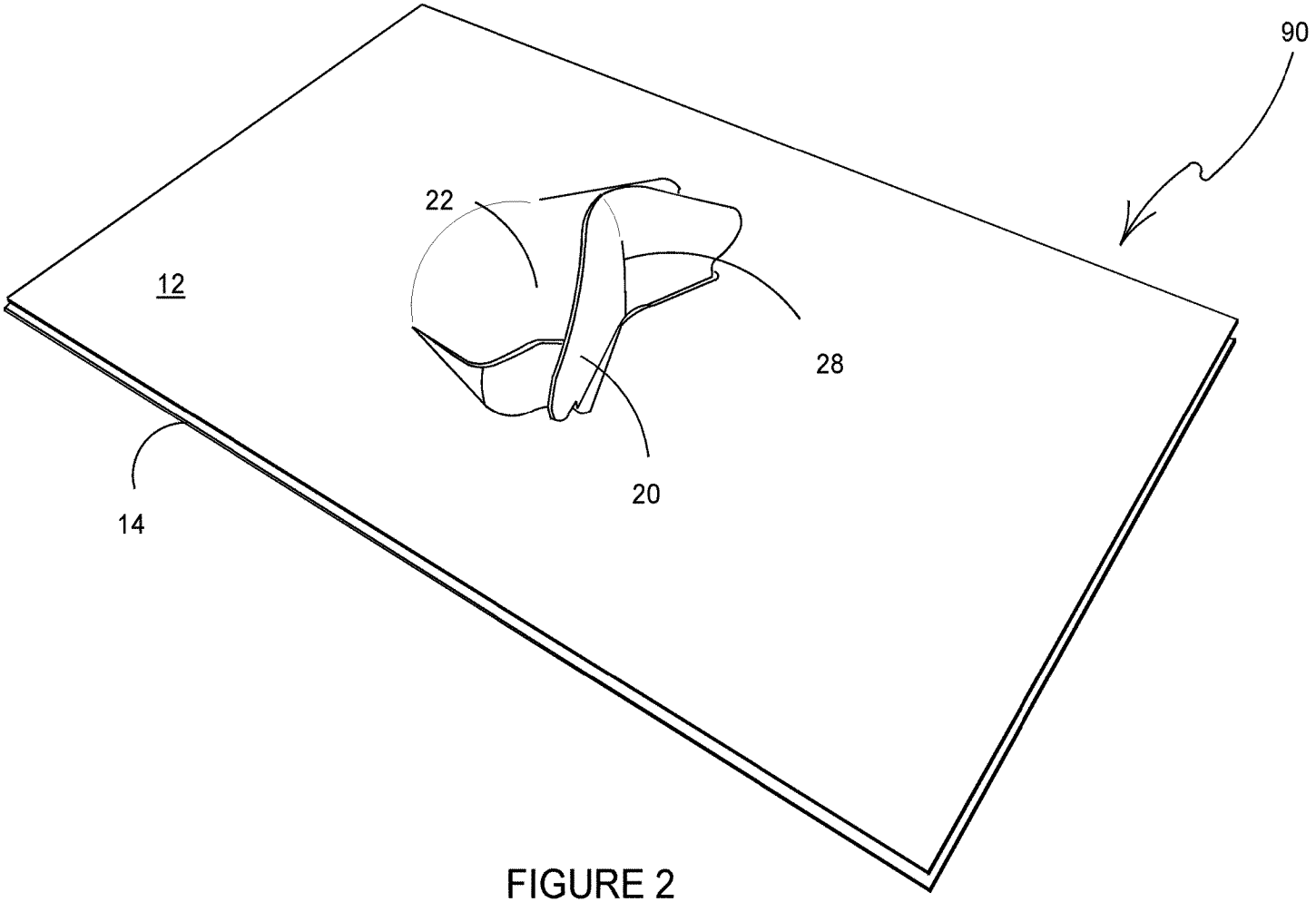
FIGS. 2 and 3 are a perspective view from above showing a first panel of the blank of FIG. 1 in locking engagement with a second panel of the blank of FIG. 1.
Figure 3:
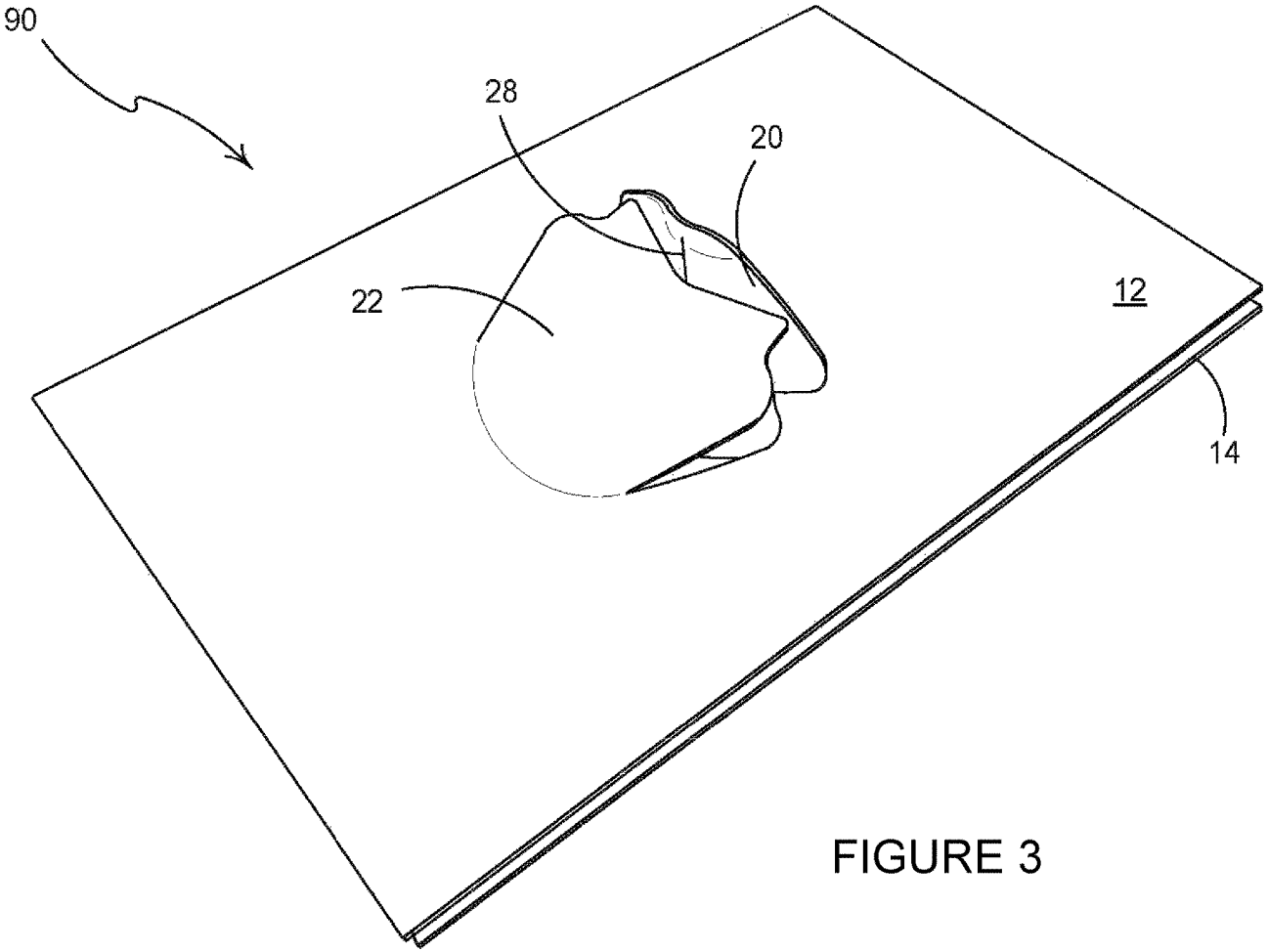
Figure 4:
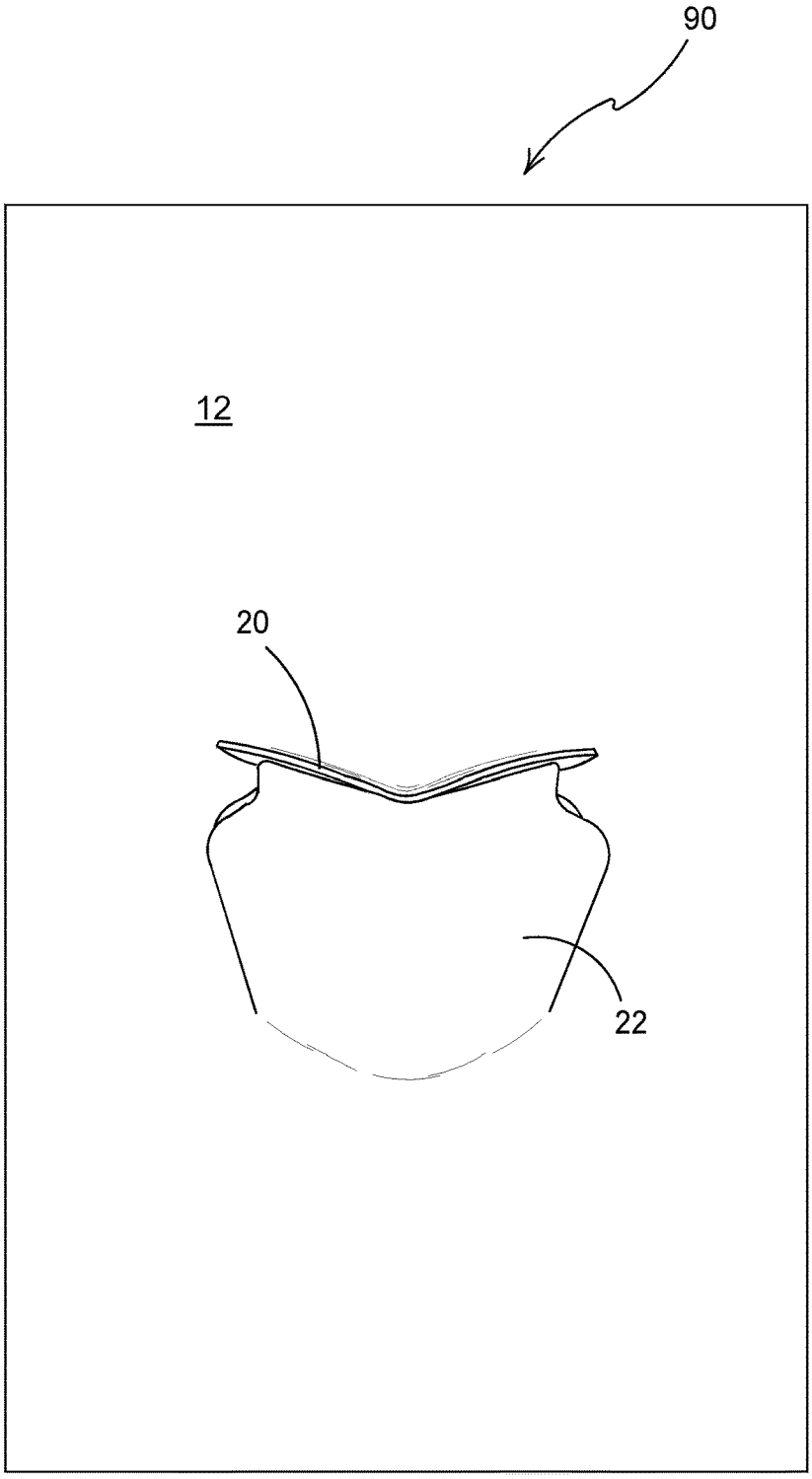
FIG. 4 is a plan view from above of the first panel of the blank of FIG. 1 in locking engagement with the second panel of the blank of FIG. 1.
Figure 5:
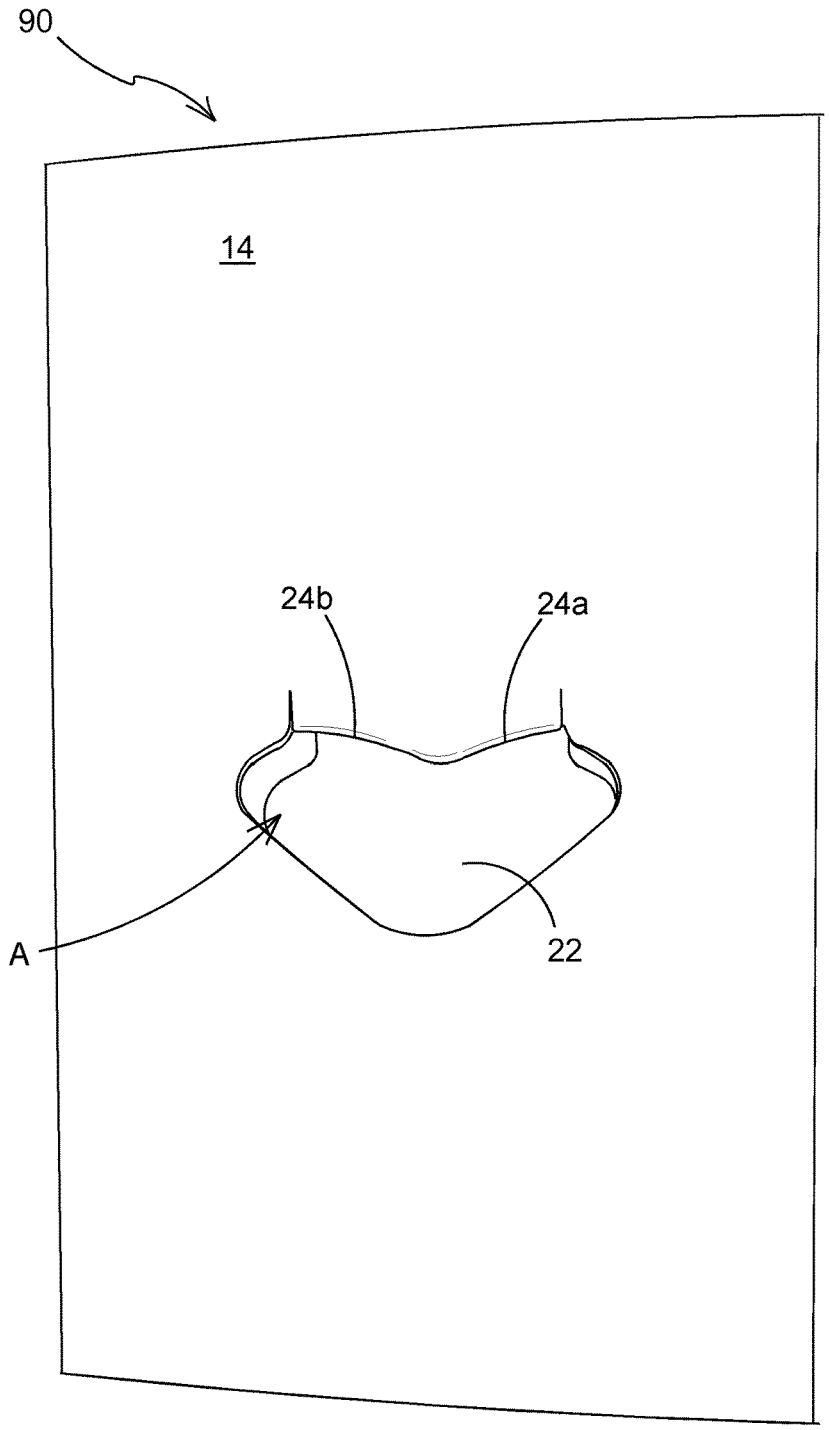
FIG. 5 is a plan view from below of the first panel of the blank of FIG. 1 in locking engagement with the second panel of the blank of FIG. 1.

The first panel 12 comprises a first part F of a complementary locking mechanism. The first part F comprises a female tab 22 defined by a severance line such as a cut line 23. The female tab 22 is integrally formed with the first panel 12. The female tab 22 is struck from the first panel 12. The female tab 22 is hingedly coupled to the first panel 12. Although no fold line is shown in FIG. 1 to connect between the female tab 22 and the first panel 12, either a linear or non-linear fold line may be used optionally to hingedly connect the female tab 22 to the first panel 12. The female tab 22 is foldable out of the plane of the first panel 12 to create an aperture "A" (see FIGS. 2 and 5) in the first panel 12. When displaced out of the plane of the first panel 12, a fold line is naturally created extending between a first end of the cut line 23 and a second end of the cut line 23. The female tab 22 comprises a recessed or concaved leading or free end 30; optionally, the recessed free end 30 is substantially V-shaped. The free end 30 comprises a first linear portion, a second linear portion and a curved, angled or otherwise non-straight portion, the non-straight portion is disposed between the first linear portion and the second linear portion to connect therebetween. The first linear portion is arranged with respect to the second linear portion so as to define a non-zero angle, such as an obtuse angle, therebetween. The orientation of the first and second linear portions is such that the first and second linear portions extend from the non-straight portion divergently toward the free edge 19 of the first panel 12. In one embodiment, the angle between the first linear portion and the second linear portion is between ninety (90) degrees and one hundred eighty (180) degrees; optionally the angle is approximately one hundred forty (140) degrees.

The second panel 14 comprises a second part M of a complementary locking mechanism. The second part M comprises a male tab 20 defined by a severance line such as a cut line 21. The male tab 20 is substantially arrow head-shaped. The male tab 20 comprises lobes or wings which provide shoulders for engaging with the first panel 12 so as to secure the male tab 20 and prevent, or at least inhibit, the male tab 20 from being withdrawn through the aperture "A" in the first panel 12 created by displacement of the female tab 22.

The female tab 22 is shaped so as to accommodate the lobes or wings when folded and inserted through the first panel 12. The female tab 22 comprises shoulders which, when the female tab 22 is folded out of the plane of the first panel 12, define a widest point of the aperture "A" thus allowing the lobes to pass freely therethrough. When folded into position, the lobes of the male tab 20 engage with portions of the first panel 12 previously adjacent (before displacement of the female tab 22 out of the plane of the first panel 12) to the shoulders of the female tab 22. The female tab 22 maintains the lobes of the male tab 20 in position over the portions of the first panel 12.

The male tab 20 is integrally formed with the second panel 14. The male tab 20 is struck from material forming the second panel 14 although in alternative embodiments the male tab may be joined to, and extend from, the free edge 25 of the second panel 14. The male tab 20 is hingedly coupled to the second panel 14 along a non-linear fold line 24*a*/26/24*b*. The male tab 20 is foldable about the non-linear fold line out of the plane of the second panel 14. The non-linear fold line comprises a first linear fold line 24*a* and a second linear fold line 24*b*. The first linear fold line 24*a* is arranged with respect to the second linear fold line 24*b* so as to define a non-zero angle, such as an obtuse angle, therebetween. In one embodiment, the angle between the first linear fold line 24*a* and the second linear fold line 24*b* is between ninety (90) degrees and one hundred eighty (180) degrees; optionally the angle is approximately one hundred forty (140) degrees. The first linear fold line 24*a* is interconnected to the second linear fold line 24*b* by an arched, angled or otherwise non-straight cut line 26; that is to say the cut line 26 is interposed between the first linear fold line 24*a* and the second linear fold line 24*b*. The first and second linear fold lines 24*a*, 24*b* extend from the non-straight cut line 26 divergently toward the proximal end of the male tab 20, the proximal end being located at the end opposite to the free end 27. Stated differently, the first and second linear fold lines 24*a*, 24*b* extend divergently away from the free end of the male tab 20. A weakened line such as a linear cutline 28 extends from a vertex (or midpoint) of the cut line 26 towards the free or leading end (or nose) 27 of the male tab 20. The weakened line 28 stops short of the free end 27 of the male tab 20. The vertex or midpoint of the cut line 26 and the free end 27 of the male tab 20 define a linear dimension, height or length of the male tab 20. In some embodiments the weakened line 28 extends across approximately 80% to 85%, optionally 82%, of the linear dimension. In some embodiments, the weakened line 28 terminates at a point approximately 2 mm apart from the free end of the male tab 20.

The free end 30 of the female tab 22 is shaped complementarily to the shape defined by the non-linear fold line 24*a*, 26, 24*b* of the male tab 20.

The shape defined by the non-linear fold line 24*a*/24*b*/26 predisposes the male tab to fold about the weakened line 28 to become a substantially channel-shaped, non-planar structure. The free end 30 of the female tab 22 provides a mandrel or guide to encourage the male tab 20 to turn into the substantially channel-shaped structure.

Turning to the deployment of the locking device as illustrated in FIGS. 2 to 5, the locking device can be activated by folding operations on a straight line machine so that the locking device is not required to be rotated or inverted to complete its activation. The activation process is not limited to that described below and may be altered according to particular manufacturing requirements.

The first panel 12 and the second panel 14 are brought into at least a partial overlapping relationship. Optionally, a first or outside surface of the first panel 12 is disposed in contact with a second or inside surface of the second panel 14. When the locking device is employed within panels forming a carton, the first panel 12 may be disposed internally of the second panel 14 such that the second panel 14 is placed outermost. In a carton, the first surface of the first panel 12 is an outside surface while the second surface of the second panel 14 is an inside surface. In this way, the locking device in the deployed condition is disposed within an internal volume of the carton.

The first panel 12 and the second panel 14 are arranged such that the female tab 22 is disposed on the male tab 20, in at least partial vertical registry therewith.

The male tab 20 of the second part M is pressed or punched through the first panel 12. This causes the male tab 20 to fold about the non-linear fold lines 24*a*/24*b*/26 and be displaced out of the plane of the second panel 14.

Displacing the male tab 20 allows the male tab 20 to be inserted into the aperture "A" and causes the female tab 22 to be thrust aside with respect to the first panel 12. As the female tab 22 is thrust aside, a fold line 35 (FIGS. 2 and 3) is created which extends between the opposed ends of the cutline 23.

When the male tab 20 folds about the weakened line 28 and turns into the substantially channel-shaped structure, the region of the male tab 20 between the free end of the male tab 20 and a distal end of the cutline 28 also folds; a fold line is created in the region as a consequence of the male tab 20 folding about the non-linear fold line 24*a*/24*b*/26. The region may also form a lip or ridge. Optionally, the region deforms, bends or folds partially over the female tab 22. This creates a flange for restricting upward movement, or unfolding, of the female tab 22.

The free end 30 of the female tab 22 comprises a shape which assists in folding the male tab 20 about the weakened line 28 to form the channel-shaped structure.

Each of the lobes or wings of the male tab 20 is disposed above a portion of the first panel 12 when in the folded condition, thus locking the first and second panels 12, 14 together. In the activation process, the male tab 20 is folded till it clears the female tab 22 and is brought into a braced position (shown in FIGS. 2-5) wherein the female tab 22 leans against the male tab 20. In the braced position where the male tab 20 is braced by the female tab 20, movement or unfolding of the male tab 20 is restricted. In this way a secure lock is formed between the first and second panels 12, 14.

The male tab 20 being folded about the weakened line 28 allows itself to turn into a 3-dimensional, channel shaped structure which is resistant to unintentional unfolding, to crushing and to deformation. Such a locking device is resistant to disengagement by pulling the first and second panels 12, 14 apart.

Referring now to FIGS. 6A to 9, there are shown alternative embodiments of the disclosure. In the second, third and subsequent illustrated embodiments like numerals have, where possible, been used to denote like parts, albeit with the addition of the prefix "100", "200" and so on to indicate that these features belong to the second, third or subsequent embodiment. The alternative embodiments share many common features with the first embodiment and therefore only the differences from the first embodiment illustrated in FIGS. 1 to 5 will be described in any greater detail.

Figures 6A, 6B:
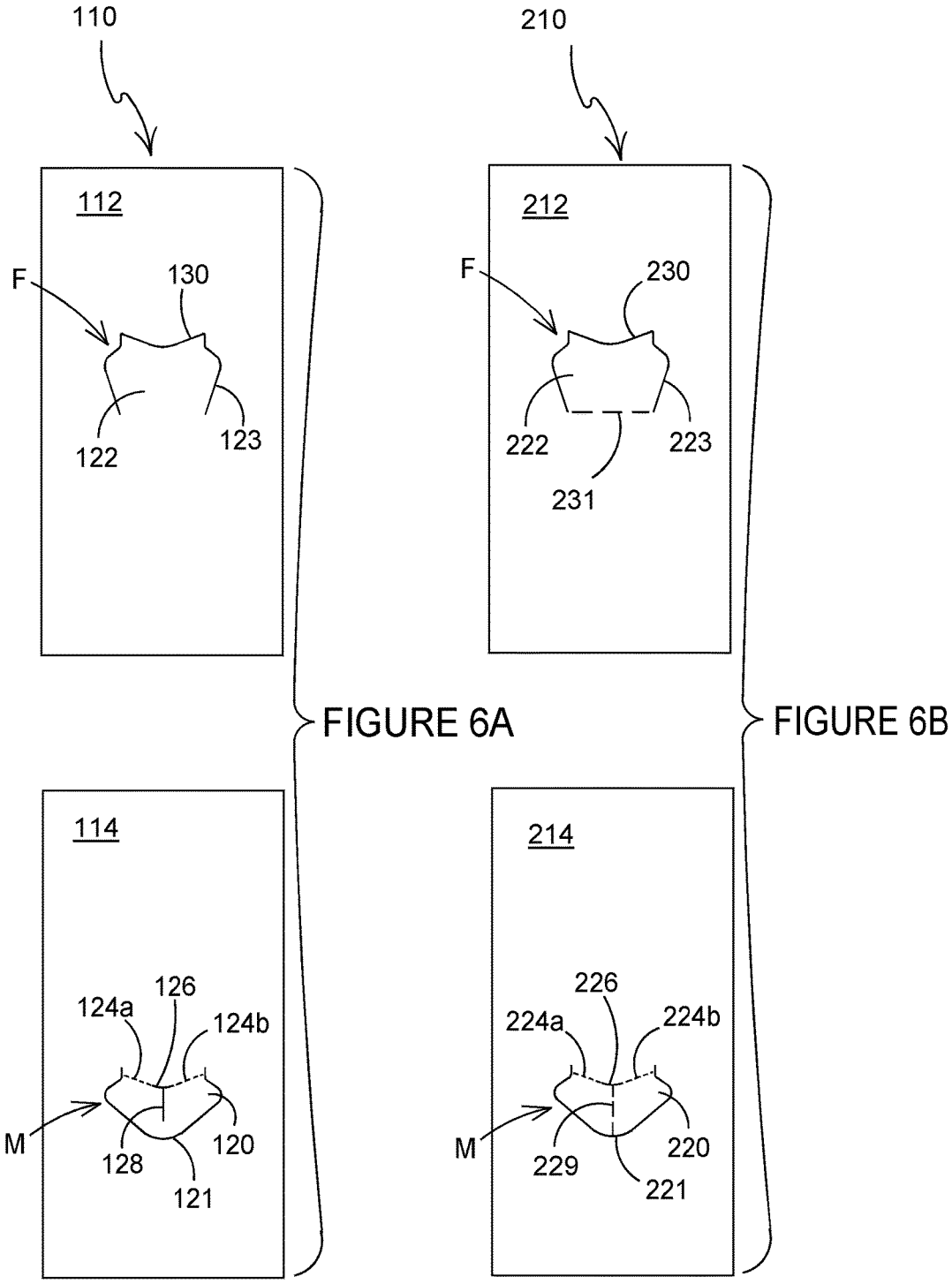
FIG. 6A is a plan view of the blank having a complementary locking mechanism according to a second embodiment of the invention.
FIG. 6B is a plan view of the blank having a complementary locking mechanism according to a third embodiment of the invention.

Referring to FIG. 6A there is shown a second embodiment in which a first panel 112 comprises the first part F of a complementary locking mechanism substantially as described above in relation to the first embodiment of FIGS. 1 to 5. The second embodiment also comprises a second panel 114 having a second part M of a complementary locking mechanism. The second part M comprises a male tab 120 hingedly coupled to the second panel 114 by a non-linear fold line which is formed of first and second linear fold lines 124*a*, 124*b* and a non-straight cut 126 connecting between the first and second fold lines 124*a*, 124*b*. The male tab 120 is struck from the second panel 114. The male tab 120 is foldable about the non-linear fold line 124*a*/124*b*/126 out of the plane of the second panel 114.

The first linear fold line 124*a* is arranged with respect to the second linear fold line 124*b* so as to define a non-zero angle, such as an obtuse angle, therebetween. In one embodiment the angle between the first linear fold line 124*a* and the second linear fold line 124*b* is between ninety (90) degrees and one hundred eighty (180) degrees; optionally the angle is approximately one hundred forty (140) degrees. The first linear fold line 124*a* is interconnected to the second linear fold line 124*b* by an arched, angled or otherwise non-straight cut line 126; that is to say, the non-straight cut line 126 is interposed between the first linear fold line 124*a* and the second linear fold line 124*b*. A weakened line 128 extends from a vertex or midpoint of the arched cut line 126 towards a free end (or nose) of the male tab 120. The weakened line 128 terminates at a point spaced apart from the free end of the male tab 120. The vertex or midpoint of the arched cut line 126 and the free end of the male tab 120 define a linear dimension, height or length of the male tab. In some embodiments the weakened line 128 extends across approximately 65% to 80%, optionally 67%, of the linear dimension. In some embodiments the linear cutline 128 terminates at a point approximately 3.6 mm apart from the free end of the male tab 120.

Referring to FIG. 6B there is shown a third embodiment in which a second panel 214 comprises a second part M of a complementary locking mechanism. The second part M comprises a male tab 220 hingedly coupled to the second panel 214 by a non-linear fold line 224*a*/224*b*/226.

A weakened line 229 extends from a vertex or midpoint of the arched cut line 226 all the way to a free end (or nose) of the male tab 220. The weakened line 229 terminates at the free edge of the male tab 220. The distance between the vertex or midpoint of the arched cut line 226 and the free end of the male tab 220 defines a linear dimension, height or length of the male tab 220. In some embodiments the weakened line 229 extends across approximately 100% of the linear dimension.

The third embodiment comprises a first panel 212 including a first part F of a complementary locking mechanism. The first part F comprises a female tab 222 defined by a severance line such as a cut line 223. The female tab 222 is struck from material forming the first panel 212. The female tab 222 is hingedly coupled to the first panel 212 by a fold line 231. The female tab 222 is foldable out of the plane of the first panel 212 to create an aperture in the first panel 212. When displaced out of the plane of the first panel 212, the female tab 222 is folded about fold line 231. It will be appreciated that the fold line 231 may be employed with any of the embodiments illustrated or described herein.

Figures 7A, 7B:
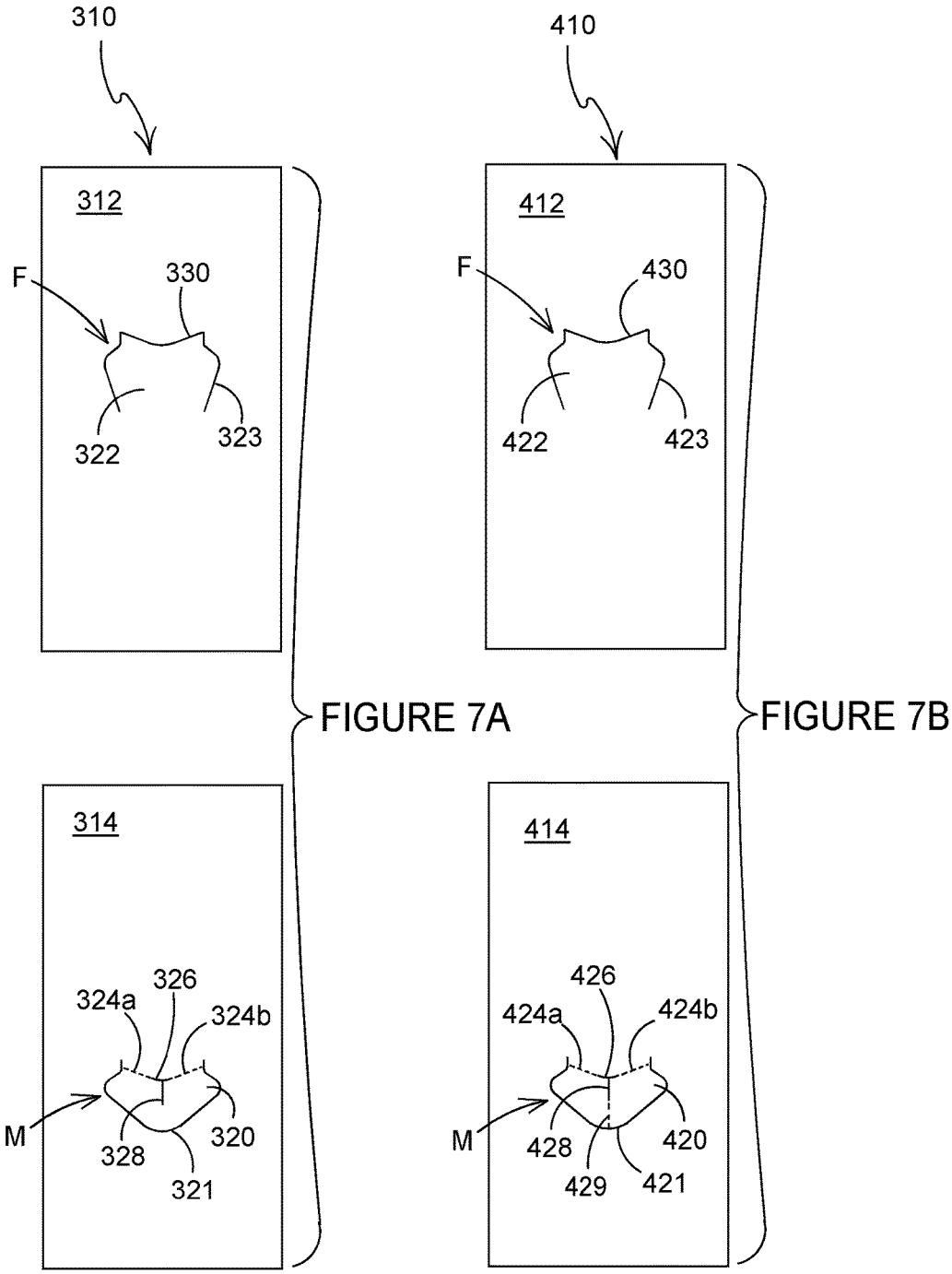
FIG. 7A is a plan view of the blank having a complementary locking mechanism according to a fourth embodiment of the invention.
FIG. 7B is a plan view of the blank having a complementary locking mechanism according to a fifth embodiment of the invention.

Referring to FIG. 7A there is shown a fourth embodiment in which a first panel 312 comprises the first part F of a complementary locking mechanism substantially as described above in relation to the first embodiment of FIGS. 1 to 5. The fourth embodiment also comprises a second panel 314 having a second part M of a complementary locking mechanism. The second part M comprises a male tab 320 hingedly coupled to the second panel 314 by a non-linear fold line that is formed of a first linear fold line 324*a*, a second linear fold line 324*b* and a non-straight cut 326. The male tab 320 is struck from material forming the second panel 314. The male tab 320 is foldable out of the plane of the second panel 314.

The distance between the vertex or midpoint of the non-straight cut line 326 and the free end of the male tab 320 define a linear dimension, height or length of the male tab. In some embodiments the weakened line 328 extends across approximately 50% to 65%, optionally 52%, of the linear dimension. In some embodiments the weakened line 328 terminates at a point approximately 5.2 mm apart from the free end of the male tab 320.

Referring to FIG. 7B there is shown a fifth embodiment in which a first panel 412 comprises a first part F of a complementary locking mechanism substantially as described above in relation to the first embodiment of FIGS. 1 to 5. The fifth embodiment also comprises a second panel 414 having a second part M of a complementary locking mechanism. The second part M comprises a male tab 420 hingedly coupled to the second panel 414 by a non-linear fold line.

The vertex or midpoint of the non-straight cut line 426 and the free end of the male tab 420 define a linear dimension, height or length of the male tab. In some embodiments the linear cutline 428 extends across approximately 50% to 65%, optionally 52%, of the linear dimension. In some embodiments, the weakened line 428 terminates at a point approximately 5.2 mm from the free end of the male tab 420.

The male tab 420 comprises a weakened line 429 which extends from a point adjacent to the terminal point of the weakened line 428 to the free end of the male tab 420. The weakened line 429 extends to the edge of the male tab 420; that is to say across, almost entirely, the remaining portion of the linear dimension. The weakened line 429 is collinear with the weakened line 428.

Figure 8:
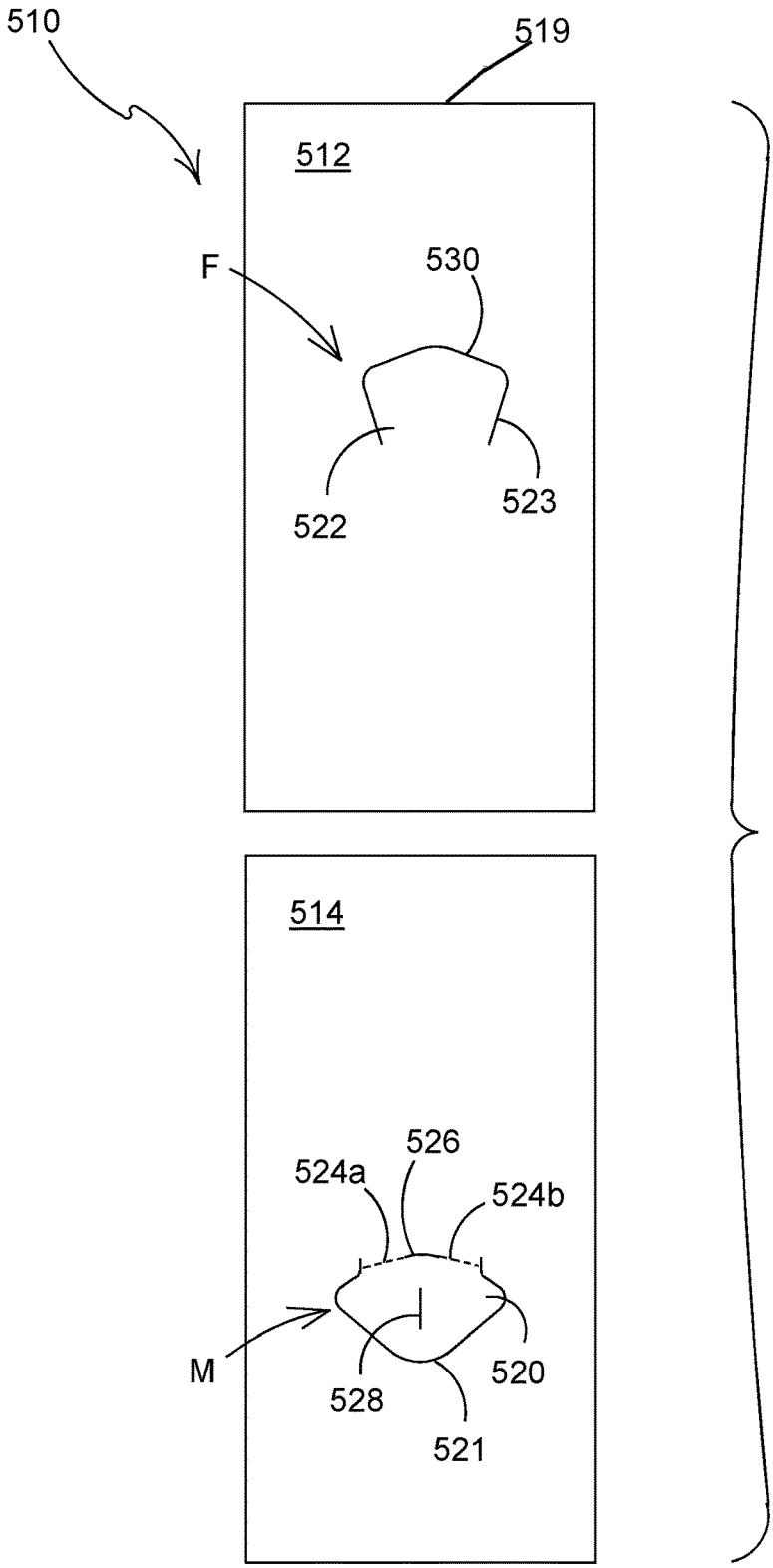
FIG. 8 is a plan view of the blank having a complementary locking mechanism according to a sixth embodiment of the invention.

Referring to FIG. 8 there is shown a sixth embodiment in which a second panel 514 comprises a second part M of a complementary locking mechanism. The second part M comprises a male tab 520 hingedly coupled to the second panel 514 by a non-linear fold line which comprises a first linear fold line 524*a*, a second linear fold line 524*b* and a non-straight cut line 526. The male tab 520 is struck from material forming the second panel 514. The male tab 520 is foldable about the non-linear fold line 524*a*/524*b*/526 out of the plane of the second panel 514.

The first linear fold line 524*a* is arranged with respect to the second linear fold line 524*b* so as to define a non-zero angle, such as an obtuse angle, therebetween. However, unlike the linear fold lines in the foregoing embodiments, the first and second linear fold lines 524*a*, 524*b* extend from the non-straight cut line 526 divergently toward the free end of the male tab 520. In one embodiment the angle between the first linear fold line 524*a* and the second linear fold line 524*b* is between ninety (90) degrees and one hundred eighty (180) degrees; optionally the angle is approximately one hundred forty (140) degrees. The first linear fold line 524*a* is interconnected to the second linear fold line 524*b* by the non-straight cut line 526 which is inverted with respect to the corresponding non-straight cut lines in the foregoing embodiments; that is to say, the non-straight cut line 526 is interposed between the first linear fold line 524*a* and the second linear fold line 524*b*. The first linear fold line 524*a*, the second linear fold line 524*b* and the non-straight cut line 526 define a generally inverted V-shape. The inverted V-shape defined by the non-linear fold line 524*a*/524*b*/526 is a mirror image of the V-shape defined by the non-linear fold line tin the embodiment of FIG. 1.

A weakened line 528, a linear cut line in FIG. 8, is provided in the male tab 520. The weakened line 528 is orientated to extend along a notional line extending from the midpoint of the cut line 526 to the free end of the male tab 520. In some embodiments the weakened line 528 terminates at a point spaced (e.g., at approximately 5.2 mm) from the free end of the male tab 520. In some embodiments the weakened line 528 terminates at a point spaced (e.g., at approximately 5.2 mm) from the midpoint of the cut line 526.

The distance between the midpoint of the non-straight cut line 526 and the free end of the male tab 520 define a linear dimension, height or length of the male tab along the notional line. In some embodiments, the weakened line 528 extends across approximately 30% to approximately 60%, optionally about 40% to about 50% (for example 42%) of the linear dimension.

The sixth embodiment comprises a first panel 512 including a first part F of a complementary locking mechanism. The first part F comprises a female tab 522 defined by a severance line such as a cut line 523. The female tab 522 is integrally formed with the first panel 512. The female tab 522 is struck from material forming the first panel 512. The female tab 522 is foldably coupled to the first panel 512. The female tab 522 is foldable out of the plane of the first panel 512 to create an aperture in the first panel 512. When displaced out of the plane of the first panel 512 the female tab 522 is folded to create a fold line. The female tab 522 comprises a free end 530. The free end 530 is shaped complementarily to the non-linear fold line 524*a*/524*b*/526 defining the inverted V-shape. The linear portions of the free edge 530 extend from the non-straight portion of the free end 530 divergently away from the free edge 519 of the first panel 512. Stated differently, the free end 530 is bulged or convex unlike the free end 30 of the female tab 22 in the first embodiment. In this way, the female tab 522 forms a guide or mandrel for facilitating folding of the male tab 520 about the weakened line 528. It will be appreciated that the male tab 520 adopts a substantially channel-shaped or V-shaped configuration. The V-shape of the male tab 520 in this embodiment points away from the female tab 522, whereas in the foregoing embodiments of FIGS. 1 to 7B, the channel-shape or V-shape of the male tab 20, 120, 220, 320, 420 points towards or into the female tab 22, 122, 222, 322, 422.

Figure 9:
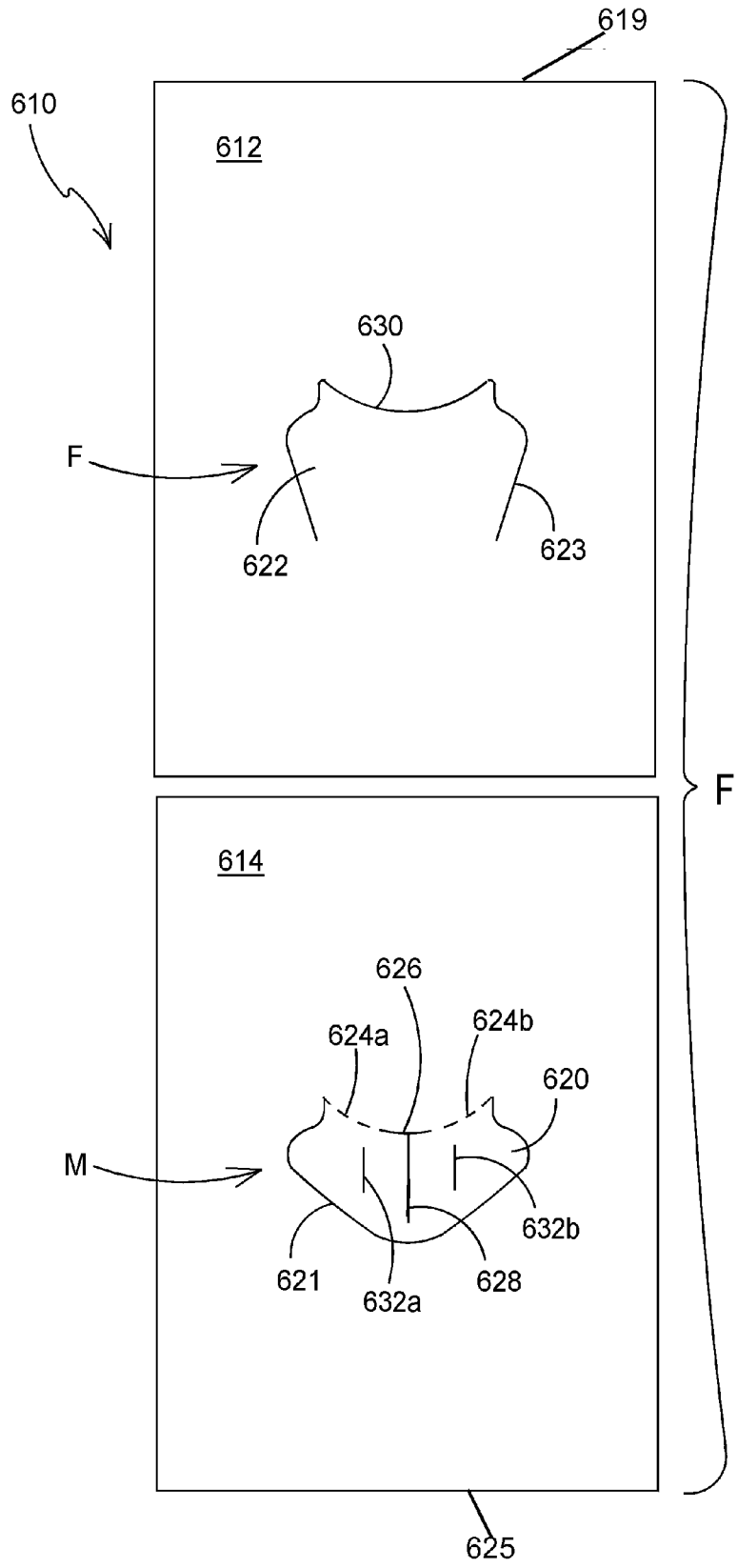
FIG. 9 is a plan view of the blank having a complementary locking mechanism according to a seventh embodiment of the invention.

Referring to FIG. 9 there is shown a seventh embodiment in which a second panel 614 comprises a second part M of a complementary locking mechanism. The second part M comprises a male tab 620 hingedly coupled to the second panel 614 by a non-linear fold line which comprises a first arcuate fold line 624*a*, a second arcuate fold line 624*b* and non-straight cut 626. The male tab 620 is struck from material forming the second panel 614. The male tab 620 is foldable about the non-linear or arched fold line 624*a*/624*b*/626 out of the plane of the second panel 614.

The first curved fold line 624*a* is arranged with respect to the second curved fold line 624*b* so as to form part of a continuous arc. The first curved fold line 624*a* is interconnected to the second curved fold line 624*b* by an arched, U-shaped or otherwise non-straight cut line 626. The non-straight cut line 626 is interposed between the first curved fold line 624*a* and the second curved fold line 624*b*. The first curved fold line 624*a*, the second curved fold line 624*b* and the non-straight cut line 626 together define a continuous arc or curve, optionally a U-shape, although an inverted U-shape may be employed in alternative embodiments. The first curved fold line 624*a*, the second curved fold line 624*b* and the arcuate or non-straight cut line 626 together constitute a non-linear or arched fold line 624*a*/624*b*/626. The first and second curved fold lines extend from the non-straight cut 626 divergently away from the free edge 625 of the second panel 614.

The first curved fold line 624*a*, the second curved fold line 624*b* and the non-straight cut line 626 define a generally U-shape whereas the first linear fold line 24*a*, the second linear fold line 24*b* and the non-straight cut line 26 of the first embodiment of FIG. 1 define a generally V-shape.

A first weakened line 628 is provided in the male tab 620. The first weakened line 628 is arranged to extend from an intermediate point of the non-straight cut line 626 and extends substantially radially outward from the arched cut line 626 towards a free end of the male tab 620. The first weakened line 628 terminates at a point spaced from the free end of the male tab 620. The distance between the vertex or midpoint of the non-straight cut line 626 and the free end of the male tab 620 define a linear dimension, height or length of the male tab 620. In some embodiments the first weakened line 628 extends across approximately 50% to 85%, optionally 70%, of the linear dimension. In some embodiments the weakened line 628 terminates at a point approximately 2 mm from the free end of the male tab 620.

Optionally, a second weakened line 632*a* is provided in the male tab 620 on a first side of the first weakened line 628. The second weakened line 632*a* is spaced apart from the first weakened line 628 and is arranged in substantially parallel to the first weakened line 628. Optionally, the second weakened line 632*a* is shorter than the first weakened line 628.

Optionally, the second linear cut line 632*a* terminates at a point spaced from the non-linear fold line 624*a*/624*b*/626.

Optionally, a third weakened line 632*b* is provided in the male tab 620 on a second side of the first weakened line 628. The third weakened line 632*b* is spaced apart from the first weakened line 628 and is arranged in substantially parallel to the first weakened line 628. Optionally, the third weakened line 632*b* is shorter than the first weakened line 628. Optionally, the third weakened line 632*b* terminates at a point spaced from the non-linear fold line 624*a*/624*b*/626.

The second and third weakened lines 632*a*, 632*b* facilitate folding or otherwise deforming of the male tab 620 into a curved or arcuate, channel-like shape. In some embodiments additional weakened lines may be provided in the male tab to facilitate folding.

The seventh embodiment comprises a first panel 612 including a first part F of a complementary locking mechanism. The first part F comprises a female tab 622 defined by a severance line such as a cut line 623. The female tab 622 is integrally formed with the first panel 612. The female tab 622 is struck from material forming the first panel 612. The female tab 622 is foldably coupled to the first panel 612. The female tab 622 is foldable out of the plane of the first panel 612 to create an aperture in the first panel 612. When displaced out of the plane of the first panel 612, the female tab 622 is folded to create a fold line. The female tab 622 comprises a recessed or concave free end 630. The free end 630 is shaped complementarily in shape to the non-linear fold line 624*a*,624*b*/626. The recessed free end 630 of the female tab 622 provides a guide or mandrel for facilitating folding or deformation of the male tab 620 into a channel-shaped structure. It will be appreciated that the male tab 620 adopts a substantially U-shaped, channel-like configuration, whereas in the foregoing embodiments of FIGS. 1 to 8 the male tab 20, 120, 220, 320, 420, 520 adopts a substantially V-shaped, channel-like configuration.

It can be appreciated that various changes may be made within the scope of the present invention. For example, the size and shape of the panels, detachable sections and frangible connections may be adjusted to accommodate articles of differing size or shape. For example, in some embodiments, the weakened line 28, 128, 328 may extend across approximately 50% to 85%, or alternatively 65% to 85% or alternatively 50% to 80%, of the linear dimension of the respective male tab 20, 120, 320. In other embodiments, the weakened line 28, 128, 328 may terminate at a point between approximately 2 mm and approximately 5.2 mm from the free end of the respective male tab 20, 120, 320. In still further embodiments, the weakened line 28, 128, 328 may terminate at a point between approximately 2 mm and approximately 3.6 mm from the free end of the respective male tab 20, 120, 320. In other embodiments, the weakened line 28, 128, 328 may terminate at a point between approximately 3.6 mm and approximately 5.2 mm from the free end of the respective male tab 20, 120, 320.

In some embodiments, additional weakened lines may be provided in the male tab to facilitate folding or deformation of the male tab to form an angular or arcuate shape; that is to say, folding the male tab so as to have a non-planar structure or shape.

It will be recognized that as used herein, directional references such as "top", "bottom", "front", "back", "rear", "end", "side", "inner", "outer", "inside", "outside", "upper" and "lower" do not limit the respective panels to such orientation, but merely serve to distinguish these panels from one another.

In the foregoing embodiments the male tab is provided with the one or more weakened lines each taking the form of, for example, a cut line which facilitates warping, or otherwise deformation, of the male tab into a channel-like, non-planar form as the male tab is folded about its non-linear fold line. However, it will be appreciated that other forms of the one or more weakened lines may be used with the invention. More particularly, the one weakened line, or each of the two or more weakened lines, may take the form of a single cut, a single score, a single half cut, a line of perforations, a line of cuts, a line of short slits, a line of half cuts, a line of scores, any combination thereof, or the like.

In some embodiments, the female tab may be provided with a linear or non-linear fold line about which the female tab may be folded out of the plane of the first panel when thrust by the male tab. When provided with a non-linear fold line, such as a V-shaped or arched fold line, the female tab may also be provided with one or more weakened lines for facilitating warping, or otherwise deformation, of the female tab into a 3-dimensional channel structure, or otherwise non-planar structure, so that the structural strength of the female tab is increased.

As used herein, the terms "weakened line" refers to a fold line or a severance line.

The term "fold line" as used herein refers to any line that defines a hinge line in a foldable sheet material, such as paperboard, for facilitating folding of portions of a blank of sheet material with respect to one another, or otherwise indicating optimal panel folding locations on the blank. A fold line may be formed by a single cut, a single score, a single half cut, a line of perforations, a line of cuts, a line of short slits, a line of half cuts, a line of scores, any combination thereof, or the like.

The term "severance line" as used herein refers to any line that defines a separation line in a foldable sheet material, such as paperboard, for facilitating separation of portions of a blank of sheet material from one another, or otherwise indicating optimal separation locations on the blank. A frangible line may be formed by a single cut, a single half cut, a line of perforations, a line of cuts, a line of short slits, a line of half cuts, any combination thereof, or the like.

It should be understood that the elements of a fold line or severance line, such as cuts, scores, half cuts, slits, perforations or the like, may be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The invention claimed is:

1. A locking device for a carton, the locking device comprising
   - a first part defined in a first panel; and
   - a second part associated with a second panel,
   - the first part comprising a female tab struck from the first panel and foldably coupled thereto, the female tab defining an aperture in the first panel when folded out of a plane of the first panel,
   - the second part comprising a male tab foldably coupled to the second panel proximate a proximal end of the male tab,
   - wherein the male tab is foldable into a braced position in the aperture wherein the female tab leans against the male tab so as to maintain the male tab in the braced position whereby the first and second panels are secured together, and
   - wherein the second part further comprises at least one weakened line disposed between the proximal end and a free end of the male tab, the at least one weakened line extending toward the free end and stopping short of the free end.

2. The locking device according to claim 1 wherein the at least one weakened line comprises one or more fold lines.

3. The locking device according to claim 2 wherein the one or more fold lines comprise one selected from the group consisting of a single cut, a single score, a single half cut, a line of perforations, a line of cuts, a line of short slits, a line of half cuts, a line of scores and any combination thereof.

4. The locking device according to claim 1 wherein the male tab is foldably coupled to the second panel along a non-linear fold line, and wherein the non-linear fold line comprises a first linear fold line and a second linear fold line arranged to define an obtuse angle therebetween.

5. The locking device according to claim 1 wherein the male tab is foldably coupled to the second panel along a non-linear fold line, and wherein the non-linear fold line comprises a first curved fold line and a second curved fold line arranged to define a continuous arc with a cutline disposed therebetween.

6. The locking device according to claim 5 wherein the at least one weakened line intersects with the non-linear fold line.

7. The locking device according to claim 1 wherein the at least one weakened line comprises two or more fold lines disposed in parallel relationship with each other.

8. The locking device according to claim 1 wherein the female tab comprises a free end which is disposed in abutment on the male tab when the male tab is in the braced position, the free end of the female tab being shaped to form a mandrel for folding the male tab into a non-planar structure.

9. The locking device according to claim 8 wherein the free end of the female tab is non-linear in shape.

10. The locking device according to claim 9 wherein the free end of the female tab is concaved.

11. The locking device according to claim 9 wherein the free end of the female tab is convex.

12. The locking device according to claim 1 wherein the male tab is struck from the second panel.

13. The locking device according to claim 1 wherein the male tab extends from a free edge of the second panel.

14. The locking device of claim 1, wherein the male tab, when folded about the proximal end, forms a substantially channel-shaped structure.

15. The locking device of claim 1, wherein the female tab has a free end which comprises a shape that assists in folding the male tab about the at least one weakened line.

16. A blank for forming a carton, the blank comprising:

a first panel including a first part of a locking device; and a second panel including a second part of a locking device, the first part comprising a female tab struck from the first panel and foldably coupled thereto, the female tab defining an aperture when folded out of a plane of the first panel, the second part comprising a male tab foldably coupled to the second panel proximate a proximal end of the male tab, wherein the male tab is foldable into a braced position in the aperture wherein the female tab leans against the male tab so as to maintain the male tab in the braced position whereby the first and second panels are secured together and wherein the second part further comprises at least one weakened line disposed between the proximal end and a free end of the male tab, the at least one weakened line extending toward the free end and stopping short of the free end.

17. The blank according to claim 16 wherein the at least one weakened line comprises one or more fold lines.

18. The blank of claim 16 wherein the male tab, when folded about the proximal end, forms a substantially channel-shaped structure.

19. The blank of claim 16, wherein the female tab has a free end which comprises a shape that assists in folding the male tab about the at least one weakened line.

* * * * *